US008097125B2

(12) United States Patent
Ryan et al.

(10) Patent No.: US 8,097,125 B2
(45) Date of Patent: Jan. 17, 2012

(54) TEMPORARY WET STRENGTH SYSTEM FOR TISSUE PAPER

(75) Inventors: Michael Ryan, Newtown, CT (US); David Dauplaise, Stamford, CT (US); William Brevard, Stamford, CT (US)

(73) Assignee: Kemira Chemicals, Inc., Atlanta, GA (US)

( * ) Notice: Subject to any disclaimer, the term of this patent is extended or adjusted under 35 U.S.C. 154(b) by 669 days.

(21) Appl. No.: 11/577,598

(22) PCT Filed: Sep. 26, 2005

(86) PCT No.: PCT/US2005/034380

§ 371 (c)(1), (2), (4) Date: Dec. 23, 2008

(87) PCT Pub. No.: WO2006/044117

PCT Pub. Date: Apr. 27, 2006

(65) Prior Publication Data

US 2009/0114357 A1 May 7, 2009

Related U.S. Application Data

(60) Provisional application No. 60/620,553, filed on Oct. 20, 2004.

(51) Int. Cl.
*D21H 11/00* (2006.01)

(52) U.S. Cl. ..... 162/164.6; 162/158

(58) Field of Classification Search ..... 162/164.6, 162/158–175; 428/118
See application file for complete search history.

(56) References Cited

U.S. PATENT DOCUMENTS

| | | | |
|---|---|---|---|
| 4,959,125 | A | 9/1990 | Spendel |
| 6,261,580 | B1 | 7/2001 | Lehrter et al. |
| 6,420,013 | B1 | 7/2002 | Vinson et al. |
| 6,548,427 | B1 | 4/2003 | Shannon et al. |
| 6,586,588 | B1 | 7/2003 | Cimecioglu et al. |
| 2003/0135939 | A1 | 7/2003 | Sun et al. |

FOREIGN PATENT DOCUMENTS

| | | | |
|---|---|---|---|
| WO | 0129315 | A | 4/2001 |
| WO | 0129315 | A1 | 4/2001 |

OTHER PUBLICATIONS

European Search Report, European Application No. EP05801881; Date of Mailing: Oct. 3, 2007; 5 pages.

International Search Report; International Application No. PCT/US2005/034380; Aug. 18, 2006.

Written Opinion; International Application No. PCT/US2005/034380; Aug. 18, 2006.

Caulfield, Daniel F., "Ester crosslinking to improve wet performance of paper using multifunctional carboxylic acids, butanete3tracarboxylic and citric acid", vol. 77, No. 3, Tappi Journal, pp. 205-212.

International Search Report; International Application No. PCT/US2005/034820; Date of Mailing: Jun. 14, 2006.

Office Action—Final for U.S. Appl. No. 11/577,603, Filing Date: Jul. 24, 2007; First Named Inventor: Naijie Zhang; Mail Date: Oct. 28, 2010.

Office Action—Non-Final for U.S. Appl. No. 11/577,603, Filing Date: Jul. 24, 2007; First Named Inventor: Maijie Zhang; Mail Date: May 27, 2010.

Office Action—Restriction/Election for U.S. Appl. No. 11/577,603, Filing Date: Jul. 24, 2007; First Named Inventor: Naijie Zhang; Mail Date: Apr. 29, 2010.

The International Searching Authority, International Search Report, International Application No. PCT/US2005/034373, International Filing Date: Sep. 26, 2005, Mail Date: May 18, 2006; 3 pages.

Xu, Yufeng et al., "Wet reinforcement of paper with high-molecular-weight multifunctional carboxylic acid", vol. 82, No. 8, Tappi Journal, pp. 150-156.

Xu, Yufeng et al., "Application of polymeric multifunctional carboxylic acids to improve wet strength", vol. 81, No. 11, Tappi Journal, pp. 159-164.

*Primary Examiner* — Mark Halpern
(74) *Attorney, Agent, or Firm* — Thomas, Kayden, Horstemeyer & Risley, LLP

(57) ABSTRACT

The invention relates to a composition comprising a (a) a temporary wet strength agent component capable of forming hemi-acetal bonds with the fibers of a tissue web to provide initial wet strength, subsequent rapid degradation of the initial wet strength when the tissue web contacts water; and (b) a sizing agent component capable of imparting water-repelling properties to the tissue web; such that the strength agent component and the sizing agent component are present in sufficient amounts so that when the composition is added to a tissue pulp slurry during a tissue-making process, tissue made from the tissue-making process exhibits a combination of (i) improved initial wet tensile, (ii) improved decay, and (iii) absorbency.

8 Claims, No Drawings

TEMPORARY WET STRENGTH SYSTEM FOR TISSUE PAPER

This application is a 371 of PCT/US05/34380 filed on 26 Sep. 2005

BACKGROUND

The tissue industry has had a long-felt need for a very high decaying temporary wet strength agent system. Poor decay translates into the clogging of pipes and septic systems. While many consumers desire wet strength in their tissue, there are consumers who do not purchase tissue containing a temporary wet strength agent due to this problem. A tissue with high initial wet strength and outstanding decay would provide needed benefits. Further, if such a tissue product also had excellent water absorbency, e.g., an absorbency that is less than 25 seconds, as measured by the water drop test, consumers and tissue makers would use and enjoy a product having such a combination of properties.

SUMMARY

The invention relates to a composition containing a premixed blend of: (a) a temporary wet strength agent component capable of forming hemi-acetal bonds with the fibers of a tissue web to provide initial wet strength, subsequent rapid degradation of the initial wet strength when the tissue web contacts water; and (b) a sizing agent component capable of imparting water-repelling properties to the tissue web. The strength agent component and the sizing agent component are present in sufficient amounts so that when the composition is added to a tissue pulp slurry during a tissue-making process, tissue made from the tissue-making process exhibits a combination of (i) improved initial wet tensile, (ii) high decay, and (iii) absorbency.

In another embodiment, the invention relates to a method for making a composition that involves the steps of mixing: (a) a temporary wet strength agent component capable of forming hemi-acetal bonds with the fibers of a tissue web to provide initial wet strength, subsequent rapid degradation of the initial wet strength when the tissue web contacts water; and (b) a sizing agent component capable of imparting water-repelling properties to the tissue web; such that the strength agent component and the sizing agent component are present in sufficient amounts so that when the composition is added to a tissue pulp slurry during a tissue-making process, tissue made from the tissue-making process exhibits (i) improved initial wet tensile, (ii) improved decay, and (iii) absorbency.

In another embodiment, the invention relates to a tissue having an absorbent fibrous cellulosic web, where the tissue includes a combination of the following properties: (1) a total area ranging from 100 to 150 $cm^2$; (2) a basis weight ranging from 5-50 gsm; (4) an initial wet tensile strength that is at least 10 $g/cm^2$; (3) an improved decay that is at least 10 points; and (4) an absorbency that is less than 25 seconds, as measured by the water drop test.

In another embodiment, the invention relates to a method for making a tissue paper.

These and other features, aspects, and advantages of the present invention will become better understood with reference to the following description and appended claims.

DESCRIPTION

The invention relates to a composition including (a) a temporary wet strength agent component capable of forming hemi-acetal bonds with the fibers of a tissue web to provide initial wet strength, subsequent rapid degradation of the initial wet strength when the tissue web contacts water; and (b) a sizing agent component capable of imparting water-repelling properties to the tissue web; such that the strength agent component and the sizing agent component are present in sufficient amounts so that when the composition is added to a tissue pulp slurry during a tissue-making process, tissue made from the tissue-making process exhibits a combination of (i) improved initial wet tensile, (ii) improved decay, and (iii) absorbency. The invention also relates to the paper made with such a composition, methods for making the paper, and methods for using the paper. The invention is based on the remarkable discovery that by using a combination of sizing agents and strength agents under certain conditions, it is possible to make a tissue having a combination of highly useful properties, namely (i) improved initial wet tensile, (ii) improved decay, and (iii) absorbency. Preferably, the initial wet tensile strength is higher as compared to when the tissue is made with only the temporary wet strength agent component at the same dose, however, without the sizing agent component, the improved decay is improved at least 10 points, as compared to when the tissue is made with only the temporary wet strength agent component in sufficient dose to deliver equivalent initial wet tensile strength to this invention, and the absorbency is less than 25 seconds, as measured by the water drop test. As used herein, the phrase "improved at least 10 points" refers to the difference between the initial wet tensile strength and thirty minute wet soak tensile strength as a percentage of initial wet tensile strength is at least ten full points or greater using the invented technology, eg, 80% vs. 70% wet tensile strength decay in thirty minutes. The phrase "the water drop test" refers to the time, measured in seconds, for a 5 microliter drop of water to absorb into a sheet of paper.

Other than in the operating examples or where otherwise indicated, all numbers or expressions referring to quantities of ingredients, reaction conditions, and the like, used in the specification and claims are to be understood as modified in all instances by the term "about." Various numerical ranges are disclosed in this patent application. Because these ranges are continuous, they include every value between the minimum and maximum values. Unless expressly indicated otherwise, the various numerical ranges specified in this application are approximations.

The temporary wet strength agent suitable for the invention can be any temporary wet strength agent capable of forming hemi-acetal bonds with the fibers of the web to provide initial wet strength in the fibrous sheet and to prevent immediate degradation of the web when the tissue product contacts water. The temporary wet strength agent component, for instance, can be selected from the group of the following temporary wet strength agents: dialdehyde starch, glyoxylated polyacrylamides, and combinations thereof. In one embodiment, the temporary wet strength agent is a glyoxylated polyacrylamide having a backbone that is less than 10,000 daltons prior to glyoxylation.

The amounts of the temporary wet strength agent can vary, depending on the application. In one embodiment, the temporary wet strength agent is in an amount that is at least 0.03 wt %, based on the weight of the dry fiber. In another embodiment, the temporary wet strength agent is in an amount that is at least 0.5 wt %, based on the weight of the dry fiber. In another embodiment, the temporary wet strength agent is present in an amount ranging from 0.03 to 0.5 wt %, based on the weight of the dry fiber.

The sizing agent component can be any sizing agent component, which when used in accordance to the invention, is capable of imparting water-repelling properties to the tissue web. For example, the sizing agent can be selected from the group of the following sizing agents: alkyl ketene dimers, alkenyl succinic anhydride, rosin size, long chain hydrocarbon anhydrides, organic isocyanates, alkyl carbamyl chlorides, alkylated melamines, styrene acrylics, styrene maleic anhydride, styrene acrylate emulsions, hydroxyethylated starches, water resistive compounds, other than those listed above, which are functionally equivalent to such compounds, and combinations thereof.

The amount of the sizing agent varies, depending on factors such as equipment, specific tissue product, and other factors involved in the application. In one embodiment, the sizing agent component is present in an amount that is at least 0.005 to 0.2 wt %, based on the weight of the dry fiber. In another embodiment, the sizing agent component is present in an amount that is at least 0.2 wt %, based on the weight of the dry fiber. In another embodiment, the sizing agent component is in an amount ranging from 0.005 to 0.2 wt %, based on the weight of the dry fiber.

A composition of the invention can be made by any suitable method. In one embodiment, such a preparation method can include the steps of mixing: (a) a temporary wet strength agent component capable of forming hemi-acetal bonds with the fibers of a tissue web to provide initial wet strength, subsequent rapid degradation of the initial wet strength when the tissue web contacts water; (b) a sizing agent component capable of imparting water-repelling properties to the tissue web, such that the strength agent component and the sizing agent component are present in sufficient amounts so that when the composition is added to a tissue pulp slurry during a tissue-making process, tissue made from the tissue-making process exhibits (i) improved initial wet tensile, (ii) improved decay, and (iii) absorbency. The temperature at which the composition is made or used varies with application.

The pulp slurry that is treated with the composition of the invention generally includes any pulp slurry, which when used in accordance to the invention, produces tissue exhibiting (i) improved initial wet tensile, (ii) improved decay, and (iii) absorbency. Papermaking fibers for making the tissue product of this invention, for instance, can include any natural or synthetic fibers suitable for the end use of products listed above including, but not limited to: nonwood fibers, such as abaca, sabai grass, milkweed floss fibers, pineapple leaf fibers; softwood fibers, such as northern and southern softwood kraft fibers; hardwood fibers, such as eucalyptus, maple, birch, aspen, or the like. In addition, furnishes including recycled fibers may also be utilized. In making the tissue products, the fibers are formed into a pulp furnish by known pulp stock formation processes. Softening agents, sometimes referred to as debonders, can be added to the tissue making process to enhance the softness of the tissue product. Such softening agents can be incorporated with the fibers before, during or after dispersing the fibers in the furnish. Such agents can also be sprayed or printed onto the web after formation, while wet, or added to the wet end of the tissue machine prior to formation. Suitable softening agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betane, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di (hydrogenated tallow) dimethyl ammonium chloride) manufactured by Akzo Chemical Company. Suitable amounts of softening agents will vary greatly with the species of pulp selected and the desired characteristics of the resulting tissue product. Such amounts can be, without limitation, from 0.05 to 1 weight percent based on the weight of fiber, more specifically from 0.25 to 0.75 weight percent, and still more specifically 0.5 weight percent.

The tissue pulp slurry generally does not contain an appreciable amount of permanent wet strength agent. In one embodiment, the pulp slurry contains a permanent wet strength resin in an amount that is less than 250 ppm. In another embodiment, the pulp slurry contains a permanent wet strength resin in an amount that is less than 100 ppm. In another embodiment, the pulp slurry does not contain any permanent wet strength resin.

In use, the invention relates to a method for making tissue having (i) improved initial wet tensile, (ii) improved decay, and (iii) absorbency. In one embodiment, the invention relates to a method that involves: (a) adding to a tissue pulp slurry a composition comprising: (1) a temporary wet strength agent component capable of forming hemi-acetal bonds with the fibers of a tissue web to provide initial wet strength and subsequent rapid degradation of the initial wet strength when the tissue web contacts water, the temporary wet strength agent being present in an amount ranging from 0.03 to 0.5 wt %, based on the weight of the dry fiber; and (2) a sizing agent component capable of imparting water-repelling properties to the tissue web, the sizing agent component being present in an amount ranging from 0.005 to 0.2 wt %, based on the weight of the dry fiber; thereby forming a tissue having (1) an initial wet tensile strength that is higher as compared to when the tissue is made with the temporary wet strength agent and without the sizing agent component, (2) an improved decay that is improved at least 10 points as compared to when the tissue is made with the temporary wet strength agent and without the sizing agent component where the dose of temporary wet strength agent is sufficient to achieve an initial wet tensile strength to this invention, and (3) an absorbency that is less than 25 seconds, as measured by the water drop test. In another embodiment, the sizing agent component is added to the surface of a tissue web while the temporary wet strength agent is added to a pulp slurry at the wet end of a papermaking process.

The composition used to make such a paper can be in various forms. In one embodiment, the composition includes a premixed blend of (a) a temporary wet strength agent component and (b) a sizing agent component capable of imparting water-repelling properties to the tissue web. In another embodiment, the composition is added in a pulp slurry as a separate addition of the temporary wet strength agent and the sizing agent. The sizing agent may be emulsified in starch or water-soluble polymer prior to addition to the furnish. The sizing agent may be emulsified in water and then post-diluted in starch or water-soluble polymer prior to addition to the furnish. Surfactant may be added to the sizing agent as a processing aid.

In one embodiment, the invention provides a method for making a composition comprising mixing: (a) a temporary wet strength agent component capable of forming hemi-acetal bonds with the fibers of a tissue web to provide initial wet strength, subsequent rapid degradation of the initial wet strength when the tissue web contacts water; (b) a sizing agent component capable of imparting water-repelling properties to the tissue web.

The invention provides a tissue product of outstanding qualities. Generally, the initial wet tensile strength of the tissue is higher as compared to when the tissue is made with only the temporary wet strength agent component, the improved decay is improved at least 10 points, as compared to when the tissue is made with only the temporary wet strength agent component (and without the sizing agent, provided of course, that other materials ordinarily used in tissue-making paper applications are used) at a temporary wet strength dose which provides equivalent initial wet tensile strength of the invention, and the absorbency is less than 25 seconds, as measured by the water drop test. In one embodiment, the absorbency is less than 20 seconds. In another embodiment, the absorbency is less than 15 seconds. In another embodiment, the absorbency is less than 10 seconds. In another embodiment, the absorbency is less than 5 seconds. In another embodiment, the absorbency is less than 2 seconds. In another embodiment, the absorbency ranges from 1 to 2, 5, 10, 15, 20, or 25 seconds.

In one embodiment, the invention includes a tissue product having an absorbent fibrous cellulosic web, such that the tissue includes a combination of the following properties: (1) a total area ranging from 100 to 150 $cm^2$; (2) a basis weight ranging from 5-50 gsm; (4) an initial wet tensile strength that is at least 10 $g/cm^2$; (3) an improved decay that is at least 10 points; and (4) an absorbency that is less than 25 seconds, as measured by the water drop test. With respect to the improved decay, in one embodiment, the improved decay is at least 15 points. In another embodiment, the improved decay is at least 18 points or at least 20 points. In another embodiment, the improved decay ranges from 10 to 20 points.

The invention is further described in the following illustrative examples in which all parts and percentages are by weight unless otherwise indicated.

Example 1

A dose of 0.1% (based on dry fiber) PAREZ 745 glyoxalated polyacrylamide resin was added to a 0.6% pulp slurry in water and mixed well. The pulp slurry was then dewatered on a forming wire and dried into a 70 $g/m^2$ paper sheet.

Example 2

A dose of 0.1% (based on dry fiber) PAREZ 745 glyoxalated polyacrylamide resin was added to a 0.6% pulp slurry in water and mixed well. A dose of 0.025% (based on dry fiber) alkenyl succinic anhydride emulsified in cationic starch (CASA) was then added to the pulp slurry and mixed well. The pulp slurry was then dewatered on a forming wire and dried into a 70 $g/m^2$ paper sheet.

Example 3

A dose of 0.1% (based on dry fiber) PAREZ 745 glyoxalated polyacrylamide resin was added to a 0.6% pulp slurry in water and mixed well. A dose of 0.09% (based on dry fiber) alkenyl succinic anhydride emulsified in cationic starch (CASA) was then added to the pulp slurry and mixed well. The pulp slurry was then dewatered on a forming wire and dried into a 70 $g/m^2$ paper sheet.

Examples 4-9

A series of paper sheets were prepared with PAREZ 745 levels of: 0, 0.05, 0.1, 0.15, 0.2, and 0.25% (based on dry fiber) and a constant CASA dose of 0.08% (based on dry fiber).

Results:

The sheets above were then cut into 2.5 cm by 10.2 cm strips. The strips were placed in a tensile tester, wet with water, then immediately pulled to measure tensile. New strips from the same sheet were placed in water for thirty minutes. These strips were then placed in the tensile tester and pulled to measure tensile. The percent decay was calculated using these measurements. Absorbency is measured using the same sheets.

| Example | Initial Wet Tensile (g/cm) | % Decay | Absorbency (sec) |
|---|---|---|---|
| 1 | 113 | 73 | 1 |
| 2 | 173 | 84 | 2 |
| 3 | 595 | 89 | 218 |

The data from Examples 1-3 show that the balance of GPAM and water resistive agent was critical in achieving the desired wet tensile, decay, and absorbency.

| Example | Initial Wet Tensile (g/cm) | % Decay | Absorbency (sec) |
|---|---|---|---|
| 4 | 427 | 90 | 75 |
| 5 | 409 | 87 | 26 |
| 6 | 306 | 80 | 4 |
| 7 | 354 | 80 | 3 |
| 8 | 313 | 79 | 5 |
| 9 | 368 | 81 | 5 |

The data from examples 4-9 demonstrate the surprising effect that GPAM's improve paper absorbency when the water resistive agent is present. This, in turn impacts initial wet tensile and decay. The three parameters are all interrelated and balancing the dose and properties is critical.

Although the present invention has been described in detail with reference to certain preferred versions thereof, other variations are possible. Therefore, the spirit and scope of the appended claims should not be limited to the description of the versions contained therein.

What is claimed is:

1. An aqueous composition comprising:

(a) a temporary wet strength agent component configured to form hemi-acetal bonds with the fibers of a tissue web to provide initial wet strength; and (b) a sizing agent component, wherein the sizing agent component imparts water-repelling properties to the tissue web.

2. The aqueous composition of claim 1, wherein the sizing agent is selected from the group consisting of alkyl ketene dimer, alkenyl succinic anhydride, rosin size, long chain hydrocarbon anhydride, organic isocyanate, alkyl carbamyl chloride, alkylated melamine, styrene acrylic, styrene maleic anhydride, styrene acrylate emulsion, hydroxyethylated starch, and a combination thereof.

3. The aqueous composition of claim 1, wherein the temporary wet strength agent component is selected from the group consisting of dialdehyde starch, glyoxylated polyacrylamides, and combinations thereof.

4. The aqueous composition of claim 3, wherein the temporary wet strength agent is a glyoxylated polyacrylamide.

5. The aqueous composition of claim 4, wherein the glyoxylated polyacrylamide has a backbone that is less than 10,000 daltons prior to glyoxylation.

6. The aqueous composition of claim 5, wherein the sizing agent is selected from the group consisting of alkyl ketene dimer, alkenyl succinic anhydride, rosin size, long chain hydrocarbon anhydride, organic isocyanate, alkyl carbamyl chloride, alkylated melamine, styrene acrylic, styrene maleic anhydride, styrene acrylate emulsion, hydroxyethylated starch, and a combination thereof.

7. The aqueous composition of claim 4, wherein the sizing agent is selected from the group consisting of alkyl ketene dimer, alkenyl succinic anhydride, rosin size, long chain hydrocarbon anhydride, organic isocyanate, alkyl carbamyl chloride, alkylated melamine, styrene acrylic, styrene maleic anhydride, styrene acrylate emulsion, hydroxyethylated starch, and a combination thereof.

8. The aqueous composition of claim 3, wherein the sizing agent is selected from the group consisting of alkyl ketene dimer, alkenyl succinic anhydride, rosin size, long chain hydrocarbon anhydride, organic isocyanate, alkyl carbamyl chloride, alkylated melamine, styrene acrylic, styrene maleic anhydride, styrene acrylate emulsion, hydroxyethylated starch, and a combination thereof.

* * * * *